United States Patent [19]

Elinsky

[11] Patent Number: 4,511,047

[45] Date of Patent: Apr. 16, 1985

[54] PRODUCT DISPLAY AND STORAGE SHELF SYSTEM

[75] Inventor: Howard S. Elinsky, University Heights, Ohio

[73] Assignee: Electroline Manufacturing Company, Cleveland, Ohio

[21] Appl. No.: 444,453

[22] Filed: Nov. 24, 1982

[51] Int. Cl.[3] ..... A47F 5/08

[52] U.S. Cl. ..... 211/90; 211/88; 211/106; 211/181; 206/44 R

[58] Field of Search ..... 211/90, 106, 88, 71, 211/181; 206/459, 494, 44 R

[56] References Cited

U.S. PATENT DOCUMENTS

| | | | |
|---|---|---|---|
| 1,747,642 | 2/1930 | Neitzke | 211/88 |
| 2,100,548 | 11/1937 | Maxin | 211/181 X |
| 2,854,134 | 9/1958 | Humphrey | 206/494 X |
| 3,085,694 | 4/1963 | Jones | 211/181 X |
| 3,680,712 | 8/1972 | Jurasek | 211/181 |
| 3,978,799 | 9/1976 | Escalette | 211/181 X |
| 3,982,685 | 9/1976 | Shimada | 206/494 X |

*Primary Examiner*—William H. Schultz
*Assistant Examiner*—Blair M. Johnson
*Attorney, Agent, or Firm*—Watts, Hoffmann, Fisher & Heinke

[57] ABSTRACT

A product display and storage shelf detachably connected to a shelf supporting structure is disclosed wherein the product supporting display section is spaced from and projects away from the shelf supporting structure to define distal and proximal display section sides for supporting products between the sides, a product supporting storage section which is disposed between the display section and the shelf support and fulcrum structure between the storage section and the display section for enabling packaged products to be moved into engagement with the fulcrum structure, tipped and slid onto the display section from the storage section.

The product containing packages are provided with a detachable side panel, product indentifying indicia on a package end panel and product identifying indicia adjacent the end panel on the opposite side of the package from the detachable side panel. The indicia are placed on the package so that the side panel indicia are visible when the package is in its storage position and the end panel indicia are visible when the package is in its display position.

12 Claims, 2 Drawing Figures

PRODUCT DISPLAY AND STORAGE SHELF SYSTEM

DESCRIPTION

1. Technical Field

The present invention relates to shelf systems and more particularly relates to product display and storage shelf systems.

2. Background Art

Product display shelves are commonly used in retail stores, warehouses, etc. and are frequently detachably connected to shelf supporting structures. Such shelves can be moved relative to each other depending upon the size of the shelved products. This minimizes the distance between vertically spaced shelves and thus maximizes the shelf space available for a given shelf support structure.

When the head space between shelves is slight, the supported products tend to be difficult to see unless positioned adjacent the projecting side of the shelf. This tends to create wasted shelf space behind the displayed product. In some environments additional products are stored on the otherwise wasted shelf space behind the products being displayed; but this sometimes creates inventory problems because the presence or absence of products in reserve at the rear of the shelf can not be readily determined by stock persons.

Shelf area sizes and shapes are frequently ill suited for displaying products as well as storing "backup" product inventory to replace depleted display products. In addition, where "backup" products are stored on display shelving it is sometimes difficult for stock persons to manipulate the stored product into a position for display, or, for that matter, to stock the shelves with "backup" products for storage.

Various examples of prior art proposals for adjustable shelf constructions are disclosed by U.S. Pat. Nos. 3,080,067; 3,627,247; 3,788,209; and, 4,241,669.

DISCLOSURE OF THE INVENTION

The present invention provides a new and improved product display and storage shelf system constructed and arranged to enable effective display of products, efficient storage of inventoried products and ready accessibility for inventory checking, replacing depleted displayed products and restocking.

In accordance with one preferred embodiment of the invention the new shelf system comprises a shelf having a product supporting display section defining sides which are distal and proximal to the shelf supporting structure, a product supporting storage section between the display section and the shelf supporting structure and fulcrum structure between the storage and display sections for enabling products supported by the storage section to be tipped and slid onto the display section.

The new storage and display shelf is particularly useful for displaying products contained in openable packages. Electrical fittings, for example, are frequently shipped to retail outlets in relatively small boxes. The boxes are placed on self-service shelves and opened to permit removal of individual fittings by purchasers. The opened packages form individual product supporting compartments on the shelves while the unopened packages provide reserve capacity.

Unopened packages are stored on the storage section in an upstanding orientation just behind the corresponding display package. When the supply of product in the display package on the display section is depleted, the empty container is removed from the shelf and the store package is tipped and slid onto the display section.

The preferred shelf is constructed so that the storage section is recessed from the adjacent display section side. This enables products to be loaded into the storage section and removed therefrom with minimal handling and manipulation in the limited vertical space between shelves.

The packages are preferably constructed to coact with the shelves and provide indicia by which purchasers, stock persons, etc. can identify the products being displayed and stored. The packages are openable along a side panel for displaying the products. The side panels having a predetermined location relative to the package indicia.

Other features and advantages of the invention will become apparent from the following detailed description of a preferred embodiment made with reference to the accompanying drawings which form part of the specification.

BEST MODE FOR CARRYING OUT THE INVENTION

Figure 1:
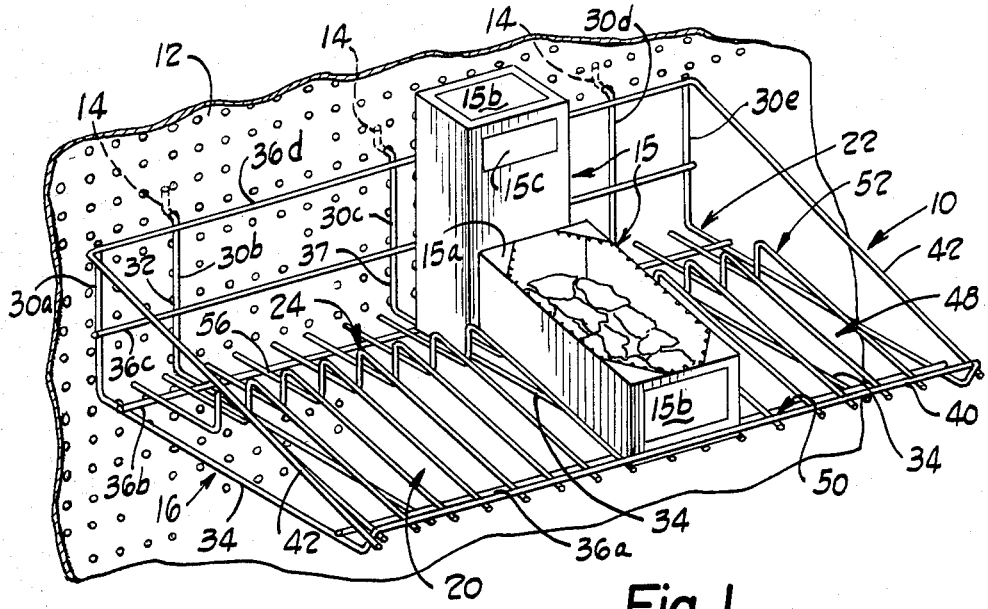
FIG. 1 is a perspective view of a display and storage shelf system embodying the present invention.

A product display and storage shelf system embodying the present invention is illustrated by FIG. 1 of the drawings. The shelf system comprises a shelf 10 detachably connected to a supporting structure 12 which is illustrated as formed by a conventional peg board panel of the sort commonly used in retail establishments to support products displayed for self service shopping. The shelf 10 is equipped with a suitable connecting structure 14 which, in the illustration, is formed by "L"-shaped rod elements attached to the shelf 10 and projecting through holes in the peg board structure 12.

The shelves are illustrated as supporting packages 15 containing individual items, such as electrical fittings, which are removed from the packages 15 by purchasers. The illustrated packages 15 each have a perforated side panel which permits a package on the shelf to be opened by tearing away the top side panel to expose the contents. The package itself thus forms a product supporting compartment on the shelf.

In the preferred and illustrated embodiment of the invention, the shelf 10 is formed by a support body 16, a product supporting display section 20 for opened packages, a product supporting storage section 22 for unopened "reserve" packages, and a fulcrum structure 24 disposed between the display section 20 and the storage section 22 for facilitating handling of the stored packages.

The support body 16 is formed by a plurality of rod members 30*a*–30*e* each comprising an upstanding segment 32 adjacent the shelf supporting structure 12 and a projecting segment 34 which extends below the display and storage sections 20, 22. Stringers 36*a*–36*d* are fixed to and extend between the rod members 30 for maintaining the rod members in position with respect to each other. The upstanding segment 32 of each rod member defines a bearing portion 37 for engaging the shelf supporting structure 12 and transmitting part of the shelf load to the structure 12 while maintaining the shelf in a generally horizontal orientation. The rod members 30*b*, 30*c*, and 30*d* have the connector members 14 formed intergrally with their uppermost ends. The connector members 14 are collectively effective to support the weight of the shelf and its contents. The bearing portions 37 prevent the connector members 14 from exerting otherwise destructive torsional forces on the structure 12.

The rod member 30*a* is continuous with the rod member 30*c* and their projecting ends are connected by a rod segment forming a lip structure 40 disposed on the projecting side of the shelf 10. The lip structure 40 prevents dislodgement of displayed product packages from the shelf. The stringer 36*d* is formed with bent opposite end segments 42 which extend from the stringer 36*d* and are welded to the lip 40 at their projecting ends to provide product retaining ends of the shelf 10.

The display section 20 is constructed and arranged to support product containing packages away from the shelf supporting structure 12 where the products displayed can be easily seen and readily removed from the shelf. The display section 20 defines a product support portion 48 extending generally horizontally with respect to the shelf support structure 12. The product support portion defines a distal side 50 remote from the shelf support and a proximal side 52 nearest the support structure 12. In the preferred embodiment of the invention the support portion 48 is sloped downwardly at a small angle with respect to horizontal proceeding away from the support structure to better display products. The support portion 48 is fixed to and supported by the stringer 36*a* and the projecting rod segments 34.

The product storage section 22 is disposed between the shelf supporting structure 12 and the display section 20 and comprises a product storage portion 56 recessed from the proximal side of the display section. The storage support portion 56 is connected to the stringer 36*b* and supported by the projecting rod segments 34.

The display and storage sections 20, 22 are preferably formed by parallelly extending, formed wires having their ends remote from the shelf supporting structure 12 each welded to the stringer 36*a*. The wire ends adjacent the shelf supporting structure are each welded to the stringer 36*b*. The segments of these wires forming the product display portion incline upwardly proceeding away from the lip structure 40 while the wire segments forming the storage portion are generally horizontal.

The wires enable construction of a relatively light weight yet strong shelf. The packages are easily moved about on the shelves because of the low friction engagement between the packages and the wires. Although the wire construction is illustrated and preferred, shelves embodying the invention can be constructed from other materials such as sheet metal or plastic.

Figure 2:
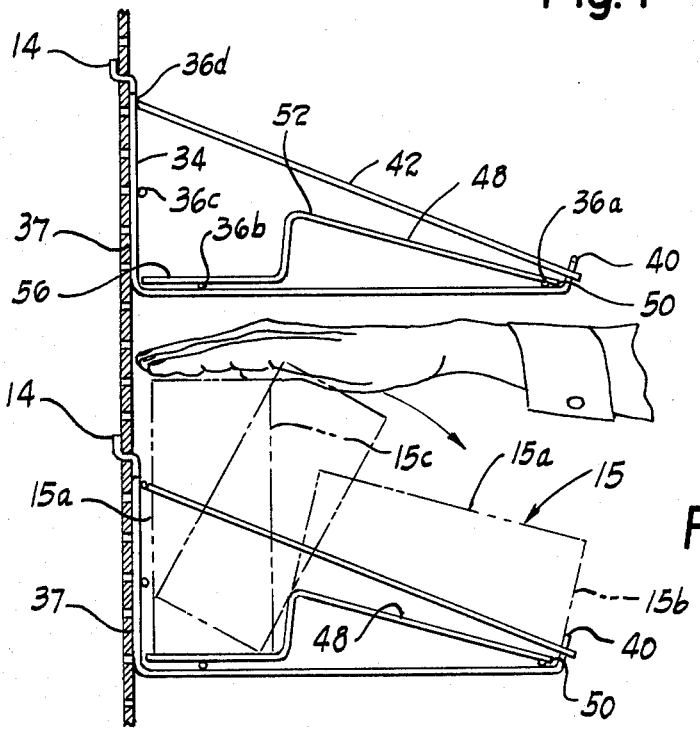
FIG. 2 is a side elevational view of two shelves embodying the present invention, each secured to a shelf supporting structure.

The fulcrum structure 24 reacts against packages being placed on and removed from the storage section 22 to enable tipping the packages into a desired position on the shelf with minimal hand manipulations. As illustrated by FIG. 2, the shelves can be positioned on the support structure 12 with minimum vertical space between them.

The lack of vertical space between prior art shelves makes manipulating packages in that space difficult, particularly since the package storage location is normally readily visible. The fulcrum construction 24 and the relationship between the storage and display sections of the new shelf 10 enables packages being restocked onto the storage section to be inserted endwise between shelves, tipped and slid endwise onto the storage section while being guided into position by the fulcrum construction. When a package on the display section is emptied of product, it is removed from the shelf and discarded. The package on the storage section is moved into engagement with the fulcrum structure 24 and tipped over (see FIG. 2), resulting in the stored package 15 sliding into position on the display section 20.

The illustrated fulcrum construction 24 is formed by radiused knee-like segments of the package supporting wires. The knee-like segments are aligned along the proximal display section side 52.

The packages 15 and shelves 10 are constructed and arranged to coact with each other to provide improved ease of use both by those who remove products from the displayed packages and those who restock the shelves. The displayed packages are disposed with their major axes extending transverse to the plane of the support structure 12, while the stored packages have their major axes extending generally parallel to the support structure. The packages 15 are specially constructed for use with the shelves 10 so that together the packages and shelves form a product display and storage system. More particularly, the packages 15 are each provided with a perforated side panel 15*a* which is torn off the package when in its display position to expose the contents for individual removal.

The adjacent package end panel 15*b* is provided with indicia identifying the package contents. The preferred indicia include the name of the product, a word description of the product, a pictorial representation, the product size, if relevant, and the number of products initially contained in the package. This information is clearly visible to anyone wishing to remove products from the displayed package and thus serves to label the shelf section occupied by the package.

Each package also bears product identifying indicia on the package panel 15*c* forming the opposite side of the package from the panel 15*a*. The indicia on the panel 15*c* are disposed adjacent the end panel 15*b* and, in the preferred package, include the same information incorporated in the indicia on the panel 15*b*. When a package is in its storage position the indica on the panel 15*c* is disposed above the displayed package so that the identity and quantity of the product contained in the stored package is visually determinable. This is particularly useful for stock persons since the supply of shelved products can readily be determined without requiring the packages on the shelves to be moved around.

While only a single embodiment of the present invention has been illustrated and described herein in considerable detail, the present invention is not to be considered limited to the precise construction disclosed. Various adaptations, modifications and uses of the invention may occur to those skilled in the art to which the invention relates and the intention is to cover hereby all such adaptations, modifications and uses falling within the scope or spirit of the appended claims.

I claim:

1. A product display and storage shelf connectable to a shelf supporting structure comprising:

(a) connecting structure by which the shelf is attachable to a shelf supporting structure;

(b) product supporting display means spaced from and projecting away from the connecting structure when the shelf is installed to define sides distal and proximal the connecting structure, said display means constructed to support product thereon between said distal and proximal sides for removal by users from said distal side;

(c) product supporting storage means disposed between said display means and said connecting structure;

(d) fulcrum means between said storage means and said display means for enabling product supported by said storage means to be moved into engagement with the fulcrum means, tipped and slid onto said display means; and, (e) stop means for preventing product from falling from the distal side of said display means.

2. The shelf claimed in claim 1 wherein said display means extends downwardly at a small angle from horizontal proceeding from said proximal side of said display means toward said distal side.

3. The shelf claimed in claim 2 wherein said storage means comprises a product supporting storage portion recessed from said proximal side of said display means.

4. The shelf claimed in claim 1 further including a support body attached to said connecting structure and having a bearing portion engageable with a shelf supporting structure, said support body comprising first and second supporting rod members each defining an upstanding segment extending adjacent a shelf supporting structure, each upstanding segment defining said bearing portion, and a projecting segment projecting from the upstanding segment below said display and storage means, and at least a stringer securing said rod members together.

5. The shelf claimed in claim 4 wherein said support body further comprises at least first and second stringers extending generally parallel to each other and connecting said projecting segments, said display and storage means fixed to said first and second stringers.

6. The display shelf claimed in claim 5 wherein said display and storage means are respectively defined by a plurality of product supporting wires defining parallelly extending first segments fixed to a first stringer and parallelly extending second segments fixed to said second stringer.

7. The shelf claimed in claim 1 wherein said storage means comprises a product supporting storage portion recessed from the adjacent proximal side of the product display means.

8. The shelf claimed in claim 7 wherein at least a portion of said display means is formed by parallel extending product engaging wires.

9. The shelf claimed in claim 8 wherein at least part of said storage means if formed by parallel extending product engaging wires.

10. A product display and storage shelf connectable to a shelf supporting structure comprising:

(a) connecting structure by which the shelf is attachable to a shelf supporting structure;

(b) product supporting display means spaced from and projecting away from the connecting structure when the shelf is installed to define sides distal and proximal the connecting structure, said display means constructed to support product thereon between said distal and proximal sides for removal by users from said distal side; (p1) (c) product supporting storage means disposed between said display means and said connecting structure;

(d) fulcrum means between said storage means and said display means for enabling product supported by said storage means to be moved into engagement with the fulcrum means, tipped and slid onto said display means; and, (e) openable product containing packages associated with the shelf to define a shelf system and wherein said display means is constructed and arranged to display products in openable packages, the displayed packages having an openable panel disposed generally parallel to the display means and extending in a plane generally transverse to a shelf supporting structure, said storage means supporting an unopened stored package with its openable panel extending in a plane transverse to the plane of the openable panel of a package on the display means.

11. The display shelf system claimed in claim 10 wherein said packages carry product identifying indicia on an end panel and on a side panel opposite said openable panel, said side panel indicia visible from the projecting side of the shelf when a package is in its storage position and said end panel indicia visible from the projecting side of the shelf when a package is in its display position.

12. The shelf system claimed in claim 10 wheren the openable panel is constructed to provide a side panel portion which is removable from the package to expose the package contents, said openable panel located on the side of a package on the means opposite to the side of the package adjacent said fulcrum means.

* * * * *